US011539160B2

(12) United States Patent
Chiu et al.

(10) Patent No.: US 11,539,160 B2
(45) Date of Patent: Dec. 27, 2022

(54) WATER-PROOF CONNECTION BETWEEN A USB 3.0 TYPE C CONNECTOR AND TRANSMISSION CABLE

(71) Applicant: GT CONTACT CO., LTD., New Taipei (TW)

(72) Inventors: Jui-Jung Chiu, Taoyuan County (TW); Chien-Chung Chiu, New Taipei (TW)

(73) Assignee: GT CONTACT CO., LTD., New Taipei (TW)

( * ) Notice: Subject to any disclaimer, the term of this patent is extended or adjusted under 35 U.S.C. 154(b) by 336 days.

(21) Appl. No.: 17/008,646

(22) Filed: Sep. 1, 2020

(65) Prior Publication Data

US 2022/0069512 A1 Mar. 3, 2022

(51) Int. Cl.

| | |
|---|---|
| ***H01R 13/52*** | (2006.01) |
| ***H01B 7/18*** | (2006.01) |
| ***H01B 7/282*** | (2006.01) |
| *H01B 7/22* | (2006.01) |
| *H01R 13/6596* | (2011.01) |

(52) U.S. Cl.

CPC ..... *H01R 13/5221* (2013.01); *H01B 7/188* (2013.01); *H01B 7/282* (2013.01); *H01B 7/228* (2013.01); *H01R 13/6596* (2013.01)

(58) Field of Classification Search

CPC ..... H01R 13/5221; H01R 13/6596; H01R 13/5804–12; H01R 13/53

See application file for complete search history.

(56) References Cited

U.S. PATENT DOCUMENTS 8,878,079 B2 * 11/2014 Colahan ..... H01R 13/6592 174/359

9,751,144 B2 * 9/2017 Wu ..... B23K 1/0016

* cited by examiner

*Primary Examiner* — Vanessa Girardi

(74) *Attorney, Agent, or Firm* — Li & Cai Intellectual Property Office

(57) ABSTRACT

A water-proof connection device and a transmission cable assembly thereof are provided. The transmission cable assembly includes a connector being USB 3.0 type C, a transmission cable, a molding holder, an insulating sleeve, and an adhesive layer. The connector has an external end portion and an opposite internal end portion. The transmission cable includes a plurality of wires connected to the internal end portion. The molding holder includes a partition portion and a pillar portion that extends from the partition portion, and connection parts of the internal end portion and the wires are embedded in the pillar portion. The insulating sleeve surrounds a part of the pillar portion and a part of the transmission cable that are arranged adjacent to each other. The adhesive layer is formed on an inner surface of the insulating sleeve, and extends outside two opposite ends of the insulating sleeve.

8 Claims, 10 Drawing Sheets

WATER-PROOF CONNECTION BETWEEN A USB 3.0 TYPE C CONNECTOR AND TRANSMISSION CABLE

FIELD OF THE DISCLOSURE

The present disclosure relates to a connection device, and more particularly to a water-proof connection device and a transmission cable assembly thereof.

BACKGROUND OF THE DISCLOSURE

Water-proofing of a conventional cable connector is mostly implemented in a colloid injection manner, and since persons skilled in the art have become accustomed to the structure of the conventional cable connector, improvement on the water-proofing of the conventional cable connector has mostly been neglected.

SUMMARY OF THE DISCLOSURE

In response to the above-referenced technical inadequacies, the present disclosure provides a water-proof connection device and a transmission cable assembly thereof to effectively improve on the issues associated with conventional cable connectors.

In one aspect, the present disclosure provides a water-proof connection device, which includes a metal housing, a transmission cable assembly, and a water-proof colloid. The metal housing has an insertion opening, an accommodating slot extending from the insertion opening along an insertion direction, and a fixing slot that extends from the accommodating slot along the insertion direction. The transmission cable assembly is inserted into the metal housing and includes a connector, a transmission cable, a molding holder, and an insulating sleeve. The connector is USB 3.0 type C and has an external end portion and an internal end portion that is opposite to the external end portion. The external end portion is arranged in the accommodating slot and corresponds in position to the insertion opening. The transmission cable includes a plurality of wires connected to the internal end portion. The molding holder includes a partition portion and a pillar portion that extends from the partition portion. A cross section of the partition portion perpendicular to the insertion direction has a shape that is identical to that of a cross section of the fixing slot perpendicular to the insertion direction, and connection parts of the internal end portion and the wires are embedded in the pillar portion. The insulating sleeve surrounds a part of the pillar portion and a part of the transmission cable that are arranged adjacent to each other. A surrounding lateral edge of the partition portion abuts against an inner wall of the fixing slot, and the fixing slot receives at least part of the pillar portion and a part of the insulating sleeve so as to leave a colloid space. The water-proof colloid is filled in the colloid space so as to connect the metal housing and the transmission cable assembly. The partition portion is configured to isolate the fixing slot from the accommodating slot, so that the accommodating slot and the insertion opening do not receive any part of the water-proof colloid.

In another aspect, the present disclosure provides a transmission cable assembly of a water-proof connection device. The transmission cable assembly includes a connector, a transmission cable, a molding holder, an insulating sleeve, and an adhesive layer. The connector is USB 3.0 type C and has an external end portion and an internal end portion that is opposite to the external end portion. The transmission cable includes a plurality of wires connected to the internal end portion. The molding holder includes a partition portion and a pillar portion that extends from the partition portion. Moreover, connection parts of the internal end portion and the wires are embedded in the pillar portion. The insulating sleeve surrounds a part of the pillar portion and a part of the transmission cable that are arranged adjacent to each other. The adhesive layer is formed on an inner surface of the insulating sleeve, and the adhesive layer extends outside two opposite ends of the insulating sleeve.

Therefore, the transmission cable assembly in the present disclosure is provided with the pillar portion of the molding holder formed on and surrounding the connection parts of the internal end portion and the wires, so that the structural connection and signal transmission between the connector and the transmission cable can be firmly maintained, and the water-proof function and the structural strength of the transmission cable assembly can be effectively achieved.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
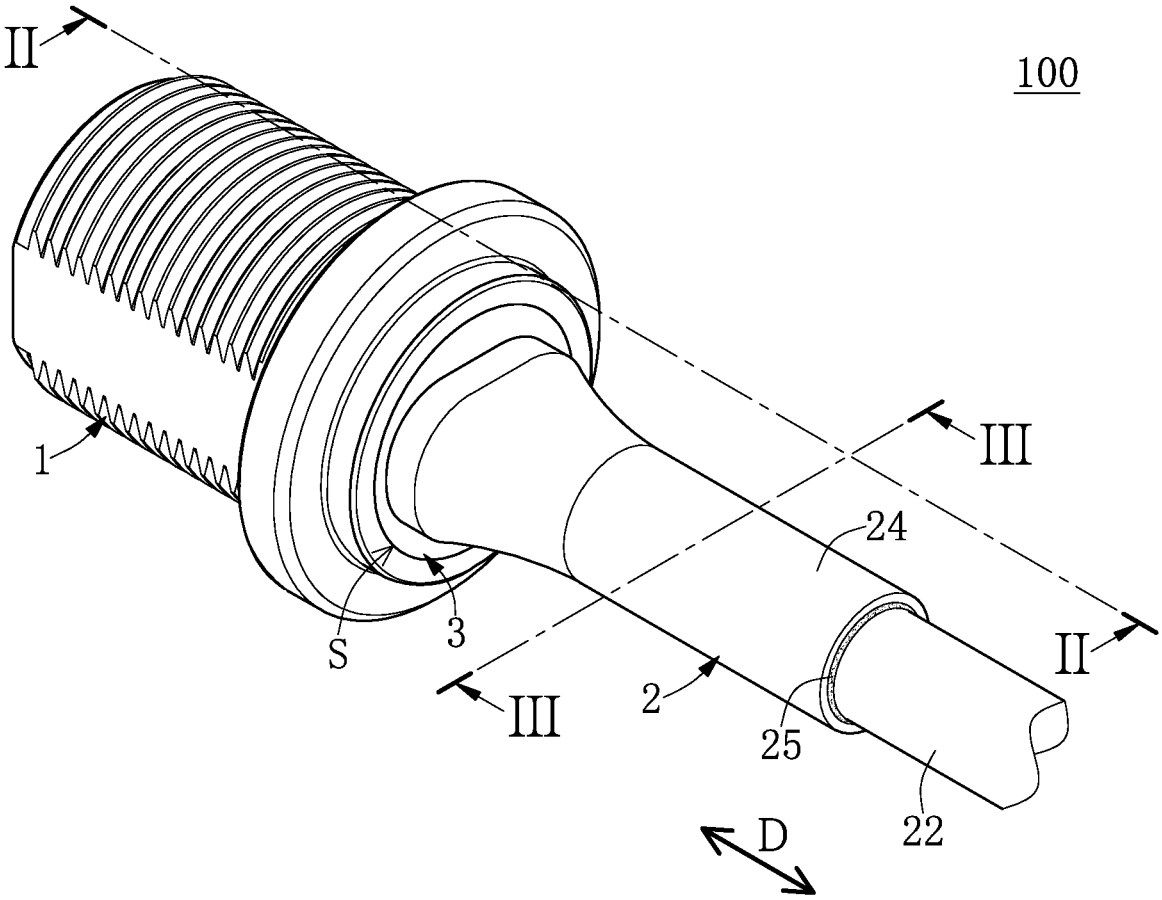
FIG. 1 is a perspective view of a water-proof connection device according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
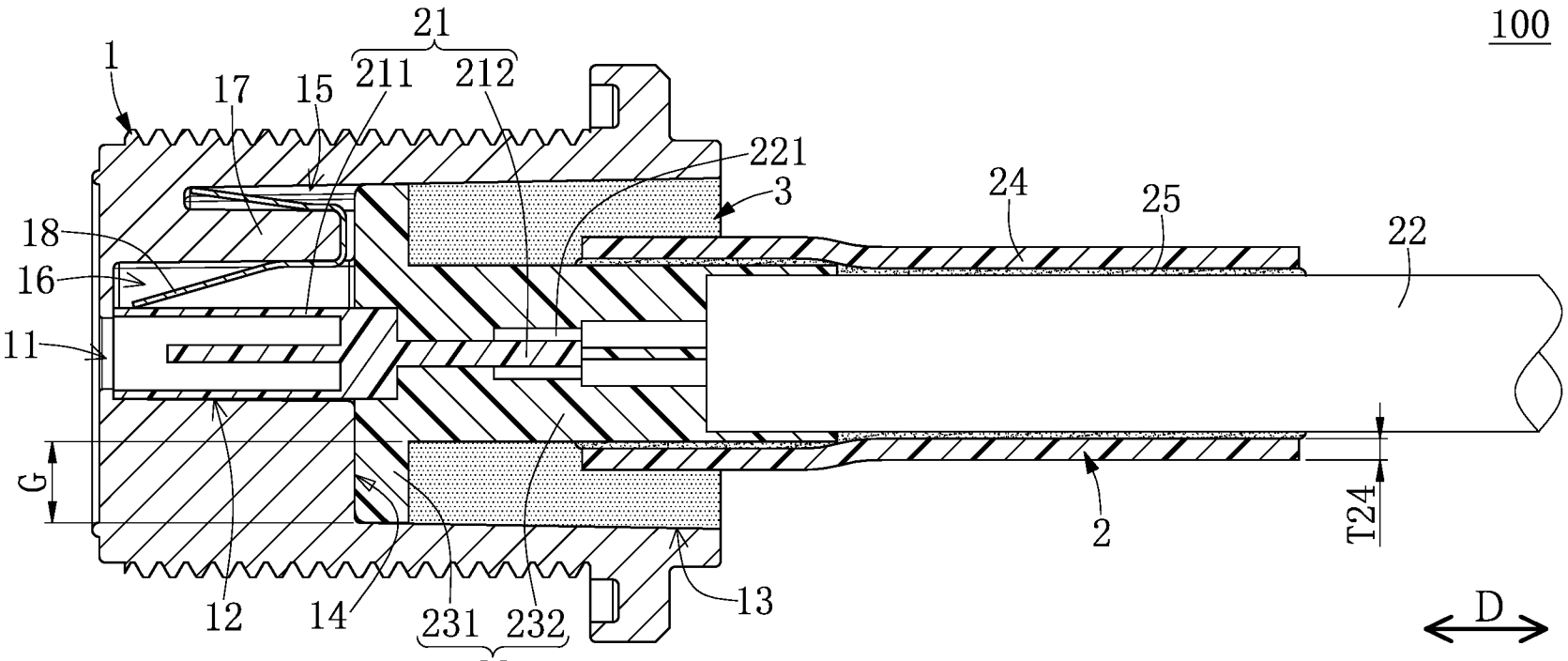
FIG. 2 is a cross-sectional view taken along line II-II of FIG. 1.
Figure 3:
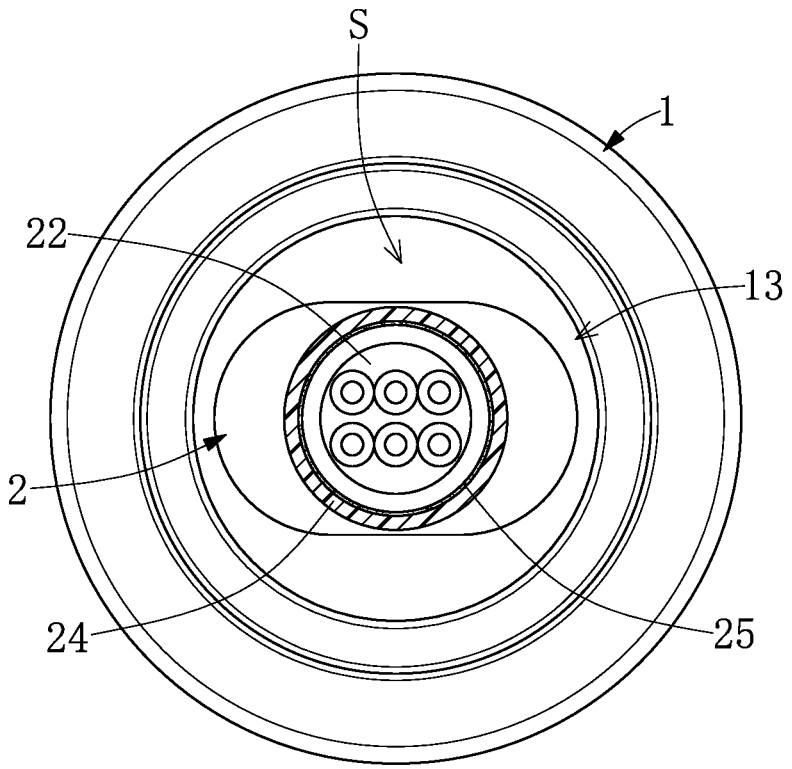
FIG. 3 is a cross-sectional view taken along line III-III of FIG. 1 with a water-proof colloid being omitted.

Referring to FIG. 1 to FIG. 6, a first embodiment of the present disclosure provides a water-proof connection device 100. As shown in FIG. 1 to FIG. 3, the water-proof connection device 100 includes a metal housing 1, a transmission cable assembly 2 inserted into the metal housing 1, and a water-proof colloid 3 that is arranged in the metal housing 1 to connect the transmission cable assembly 2 and the metal housing 1. The transmission cable assembly 2 in the present embodiment is described in cooperation with the metal housing 1 and the water-proof colloid 3, but the present disclosure is not limited thereto. For example, in other embodiments of the present disclosure, the transmission cable assembly 2 can be independently used (e.g., sold) or can be used in cooperation with other components.

It should be noted that when a high-pressure gas having 10 psi is injected into the water-proof connection device 100 of the present embodiment from the transmission cable assembly 2 (e.g., a transmission cable 22), the high-pressure gas does not flow out of the water-proof connection device 100 through the metal housing 1. In other words, any connection device not satisfying the above condition is different from the water-proof connection device 100 of the present embodiment.

The metal housing 1 is in a pillar shape, and has an insertion opening 11, an accommodating slot 12 extending from the insertion opening 11 along an insertion direction D, and a fixing slot 13 that extends from the accommodating slot 12 along the insertion direction D. In other words, the insertion opening 11, the accommodating slot 12, and the fixing slot 13 are sequentially formed by penetrating from one end of the metal housing 1 (e.g., the left end of the metal housing 1 shown in FIG. 2) to another end of the metal housing 1 (e.g., the right end of the metal housing 1 shown in FIG. 2). The insertion opening 11 and the accommodating slot 12 in the present embodiment are formed according to the standard of USB 3.0 type C, but the present disclosure is not limited thereto.

Specifically, the metal housing 1 has a step surface 14 that is connected to an inner wall of the fixing slot 13 and an inner wall of the accommodating slot 12. In other words, the fixing slot 13 and the accommodating slot 12 are respectively located at two opposite sides of the step surface 14, and the step surface 14 in the present embodiment can be regarded as a bottom wall of the fixing slot 13. The metal housing 1 has an extension slot 15 and a connection slot 16 that are recessed from the step surface 14 in a direction away from the fixing slot 13. The connection slot 16 is in spatial communication with the accommodating slot 12, and the extension slot 15 is arranged at one side of the connection slot 16 away from the accommodating slot 12.

Moreover, one side (e.g., the right side of FIG. 2) of each of the accommodating slot 12, the connection slot 16, and the extension slot 15 is in spatial communication with the fixing slot 13. The metal housing 1 has a positioning portion 17 separating the extension slot 15 from the connection slot 16. In addition, the connection slot 16 is recessed from the step surface 14 along the insertion direction D to a specific position that is adjacent to the insertion opening 11 but that does not penetrate through to the insertion opening 11.

Specifically, the metal housing 1 preferably includes a grounding component 18 (e.g., an elastic spring) corresponding in position to the accommodating slot 12. The grounding component 18 in the present embodiment is in a substantial U-shape, and clamps (or is held by) the positioning portion 17, and two opposite portions of the grounding component 18 are respectively arranged in the extension slot 15 and the connection slot 16, but the present disclosure is not limited thereto. For example, in other embodiments of the present disclosure, the metal housing 1 can be provided without the grounding component 18.

Figure 4:
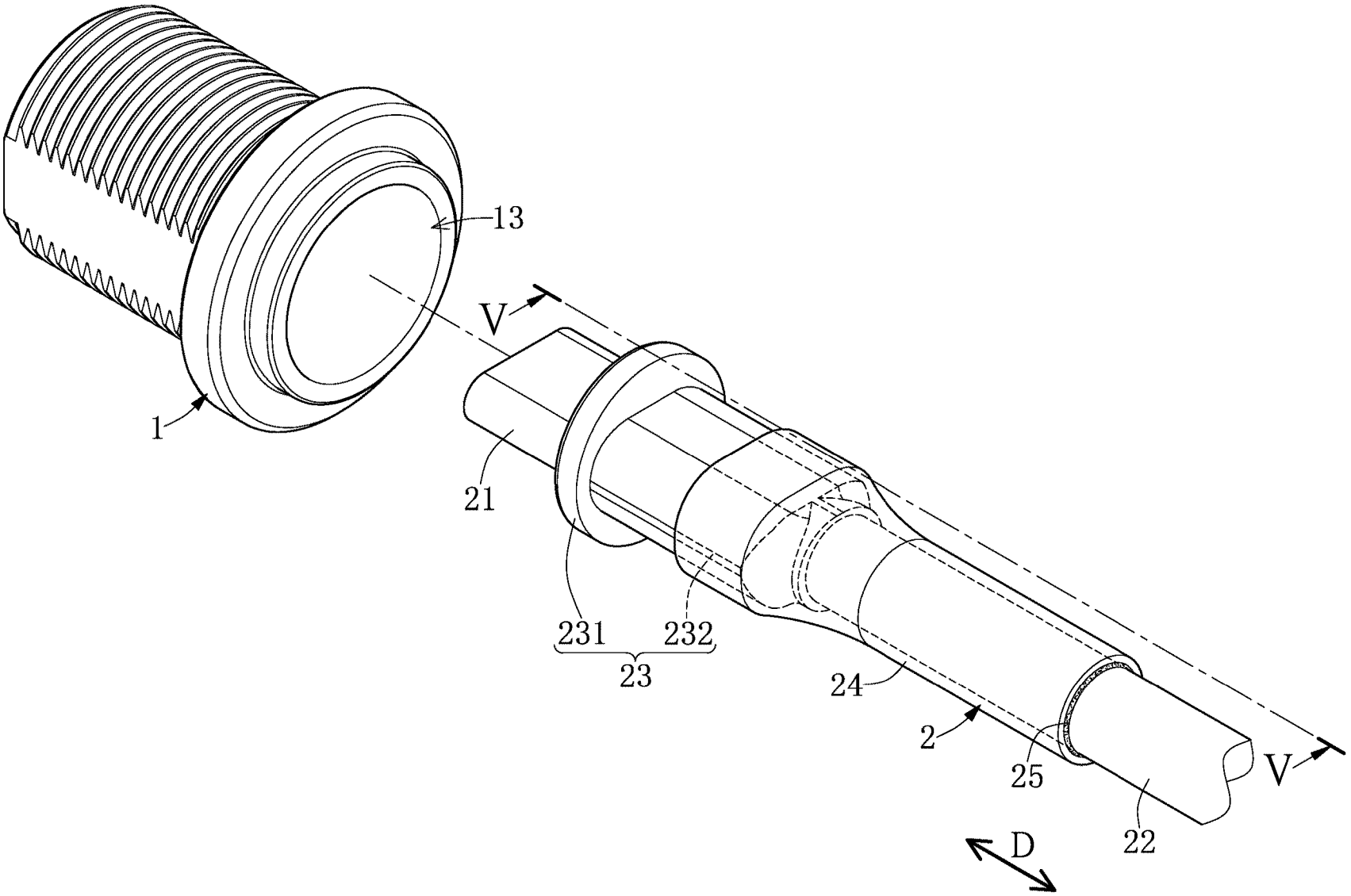
FIG. 4 is an exploded view of FIG. 1 with the water-proof colloid being omitted.
Figure 5:
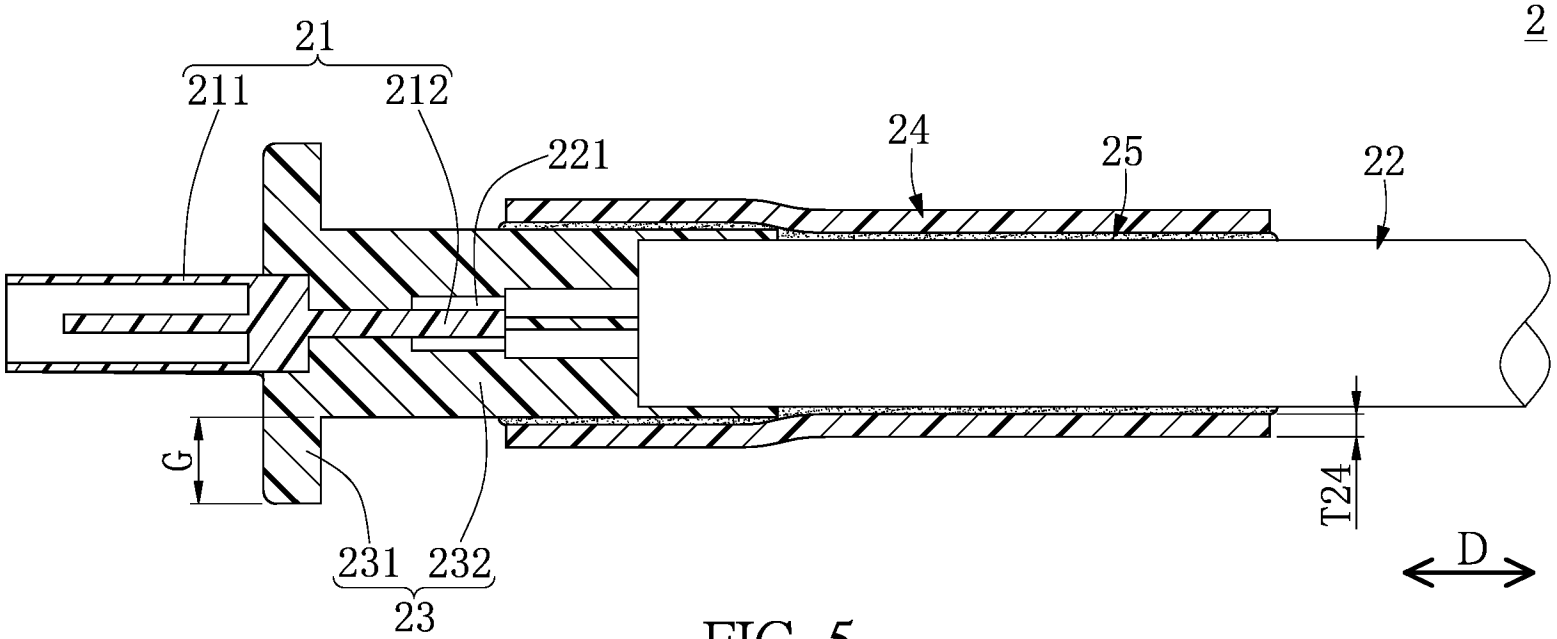
FIG. 5 is a cross-sectional view taken along line V-V of FIG. 4.
Figure 6:
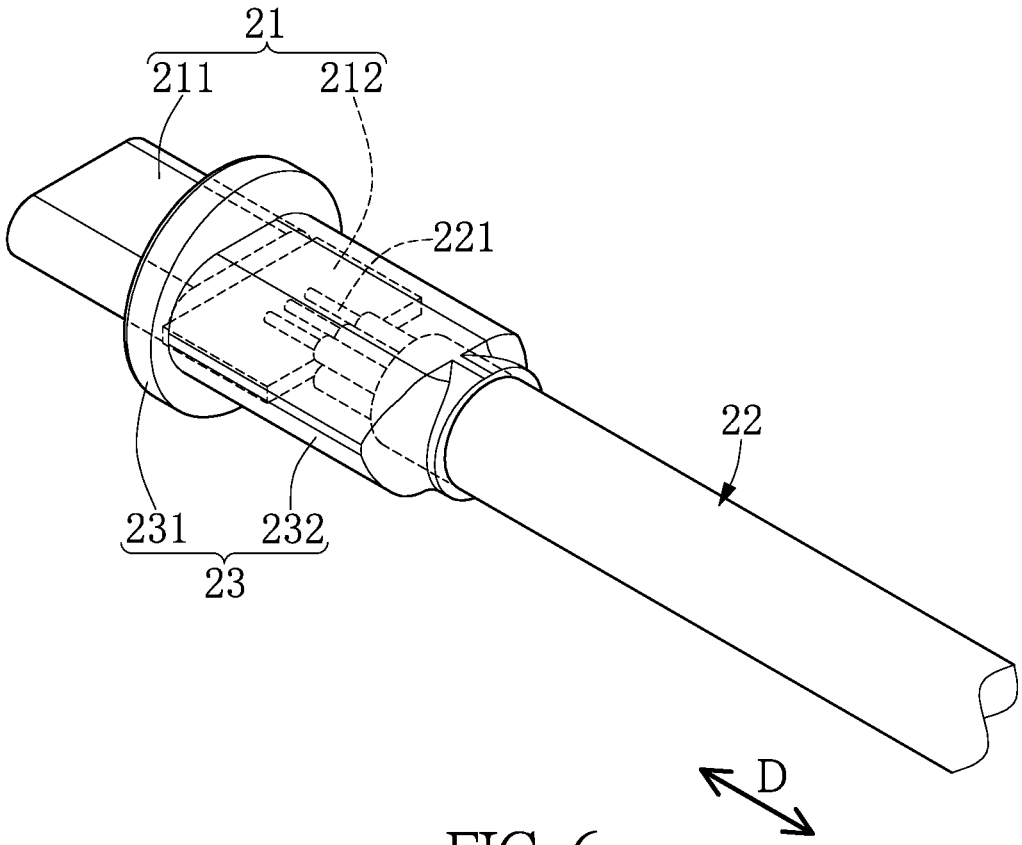
FIG. 6 is a perspective view showing a transmission cable assembly of FIG. 4 when an insulating sleeve and an adhesive layer are omitted.
Figure 7:
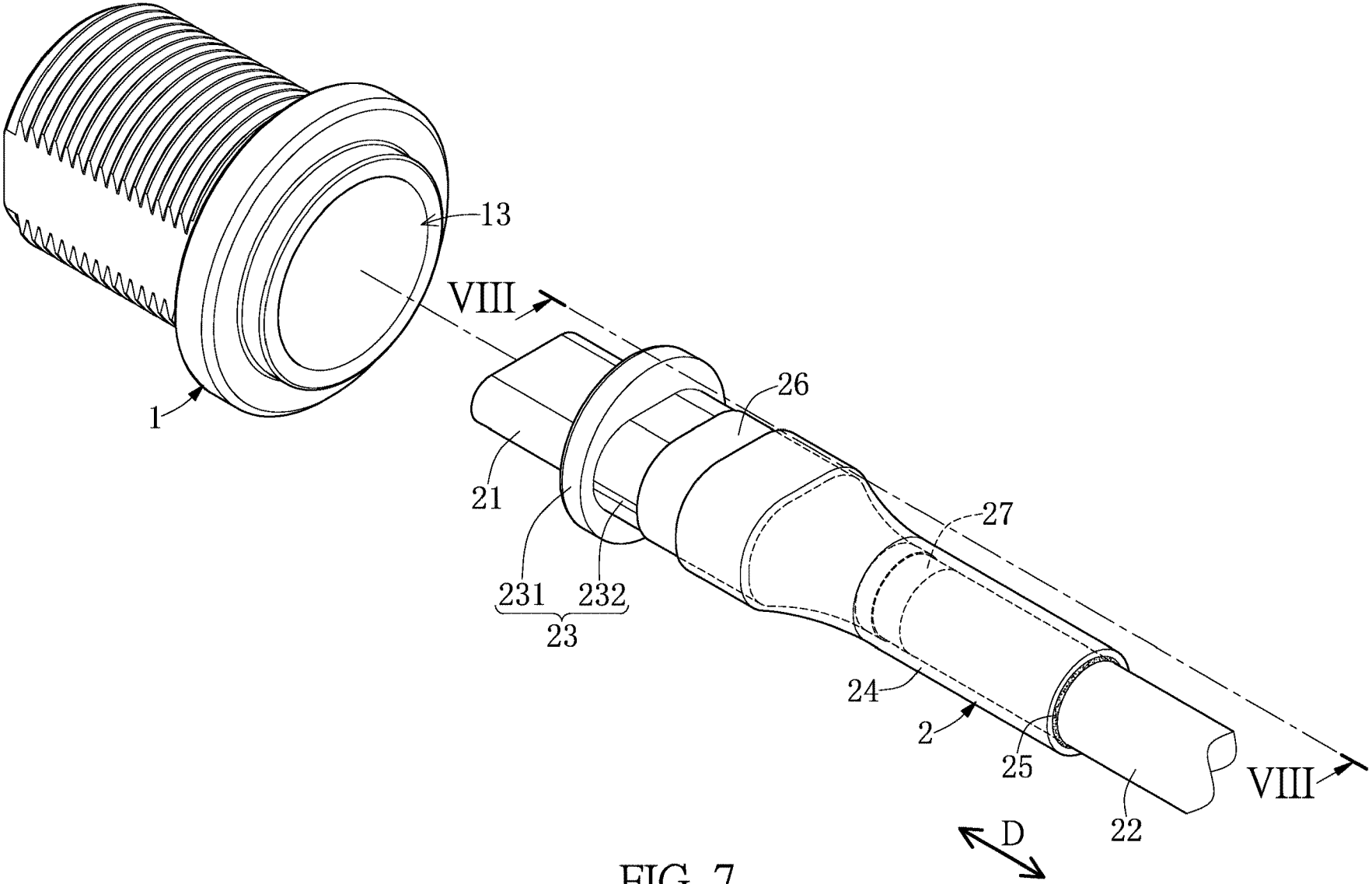
FIG. 7 is an exploded view of a water-proof connection device according to a second embodiment of the present disclosure with a water-proof colloid being omitted.
Figure 8:
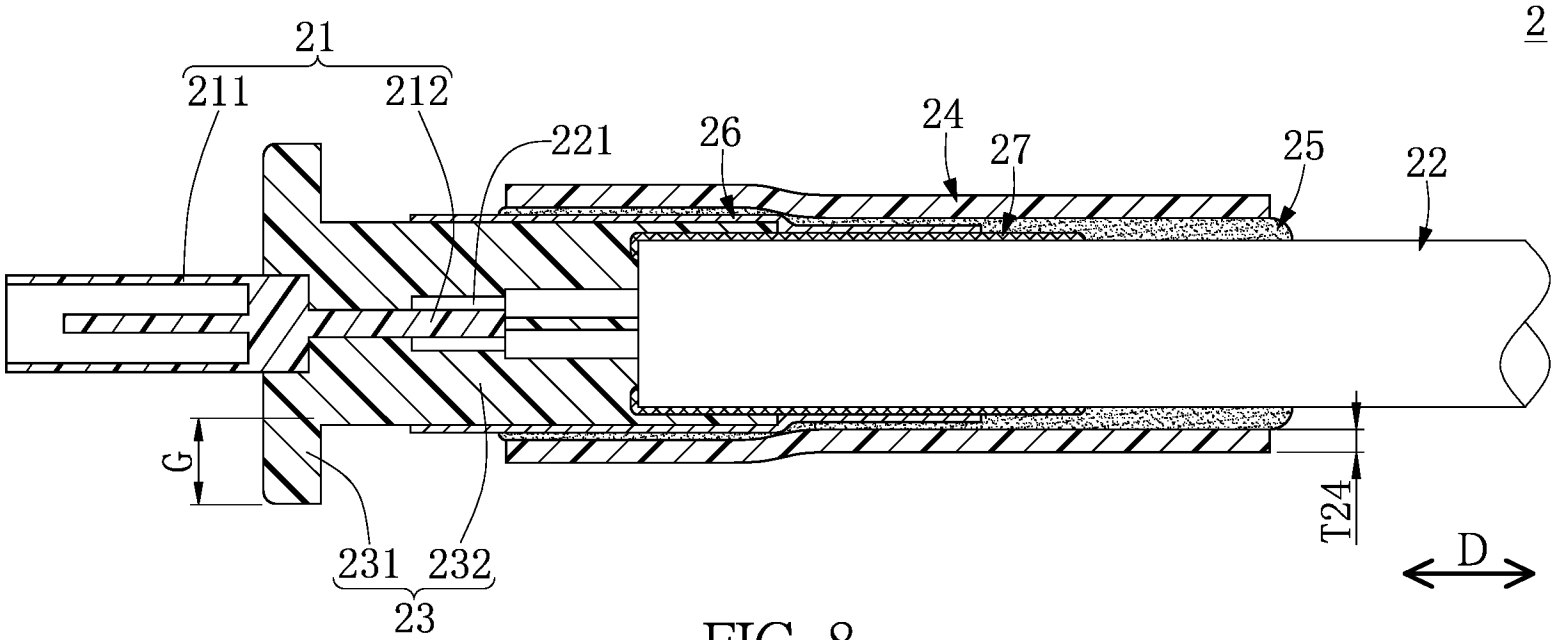
FIG. 8 is a cross-sectional view taken along line VIII-VIII of FIG. 7.
Figure 9:
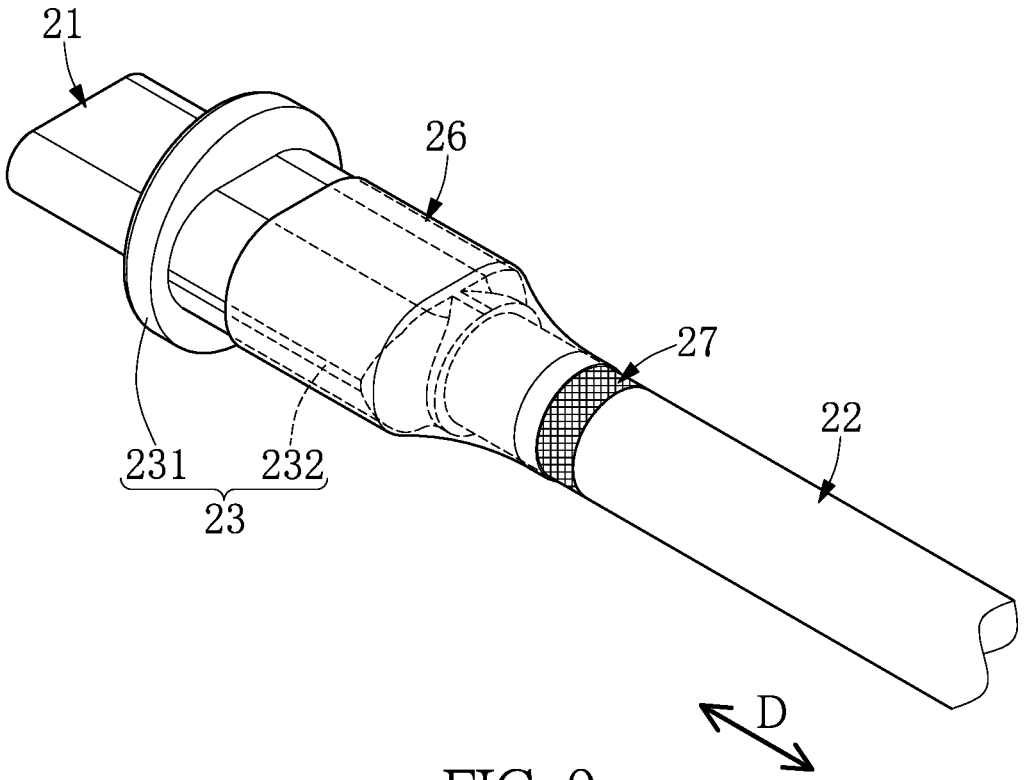
FIG. 9 is a perspective view showing a transmission cable assembly of FIG. 7 with an insulating sleeve and an adhesive layer being omitted.
Figure 10:
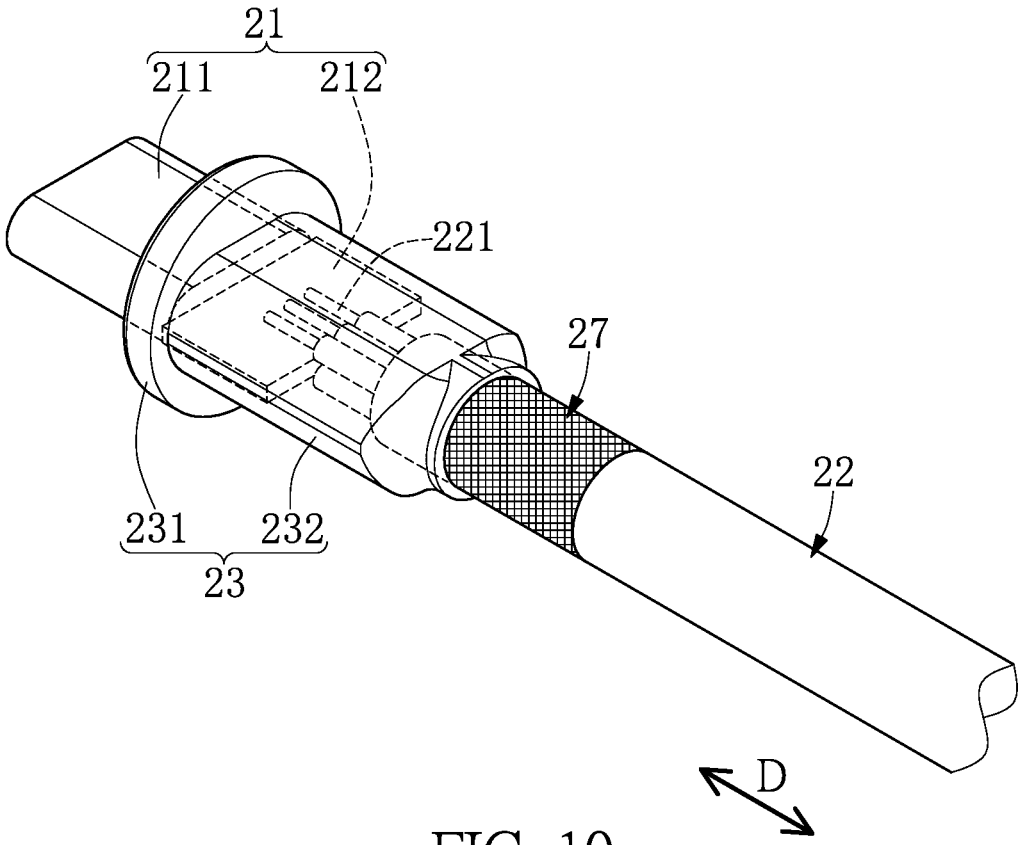
FIG. 10 is a perspective view showing the transmission cable assembly of FIG. 7 with the insulating sleeve, the adhesive layer, and a shielding layer being omitted.

As shown in FIG. 4 to FIG. 6, the transmission cable assembly 2 in the present embodiment includes a connector 21, a transmission cable 22 connected to the connector 21, a molding holder 23 surrounding the connector 21 and the transmission cable 22, an insulating sleeve 24 surrounding the transmission cable 22 and the molding holder 23, and an adhesive layer 25 that is formed on an inner surface of the insulating sleeve 24.

The connector 21 in the present embodiment is limited to USB 3.0 type C. That is to say, any connector not in the USB 3.0 type is different from the connector 21 of the present embodiment. Specifically, as shown in FIG. 2 to FIG. 4, the connector 21 has an external end portion 211 and an internal end portion 212 that is opposite to the external end portion 211. The external end portion 211 of the connector 21 is arranged in the accommodating slot 12 and corresponds in position to the insertion opening 11, and the internal end portion 212 is arranged in the fixing slot 13. Moreover, the grounding component 18 detachably abuts against the external end portion 211 (e.g., one of the two opposite portions of the grounding component 18 arranged in the connection slot 16 detachably abuts against the external end portion 211), so that the metal housing 1 and the external end portion 211 are commonly grounded.

The transmission cable 22 includes a plurality of wires 221 connected to the internal end portion 212. The molding holder 23 includes a partition portion 231 formed on the internal end portion 212 and a pillar portion 232 that extends from the partition portion 231. Moreover, connection parts of the internal end portion 212 and the wires 221 are embedded in the pillar portion 232. In other words, a portion of the connector 21 surrounded (or covered) by the molding holder 23 in the present embodiment is defined as the internal end portion 212, and the other portion of the connector 21 without being surrounded (or covered) by the molding holder 23 in the present embodiment is defined as the external end portion 211.

Accordingly, the transmission cable assembly 2 in the present embodiment is provided with the pillar portion 232 of the molding holder 23 formed on and surrounding the connection parts of the internal end portion 212 and the wires 221, so that the structural connection and signal transmission between the connector 21 and the transmission cable 22 can be firmly maintained, and the water-proof function and the structural strength of the transmission cable assembly 2 can be effectively achieved.

Furthermore, the molding holder 23 is at least partially arranged in the fixing slot 13, and the partition portion 231 abuts against the step surface 14 of the metal housing 1, so that the fixing slot 13 can be isolated from the accommodating slot 12, the connection slot 16, and the extension slot 15 through the partition portion 231. Moreover, a cross section of the partition portion 231 perpendicular to the insertion direction D has a shape that is identical to that of a cross section of the fixing slot 13 perpendicular to the insertion direction D.

A surrounding lateral edge of the partition portion 231 abuts against the inner wall of the fixing slot 13, and the surrounding lateral edge of the partition portion 231 and the inner wall of the fixing slot 13 in the present embodiment are interferingly fitted with each other so as to have an abutting region that is in a circular ring-shape. Accordingly, the partition portion 231 can be configured to effectively prevent any liquid from flowing from the fixing slot 13 to any one of the accommodating slot 12, the connection slot 16, and the extension slot 15.

Specifically, a projection region defined by orthogonally projecting the pillar portion 232 onto the partition portion 231 is located at an inner side of the surrounding lateral edge of the partition portion 231, and an outer surface of the pillar portion 232 is spaced apart from the surrounding lateral edge of the partition portion 231 by a minimum distance G. In other words, the outer surface of the pillar portion 232 does not contact the inner wall of the fixing slot 13.

The insulating sleeve 24 surrounds a part of the pillar portion 232 and a part of the transmission cable 22 that are arranged adjacent to each other, and the fixing slot 13 receives at least part of the pillar portion 232 and a part of the insulating sleeve 24 so as to leave a colloid space S. Moreover, a thickness T24 of the insulating sleeve 24 is preferably smaller than the minimum distance G, so that the colloid space S is in a ring-shape.

In the present embodiment, the insulating sleeve 24 is adhered to the part of the pillar portion 232 and the part of the transmission cable 22 that are arranged adjacent to each other by the adhesive layer 25, and the adhesive layer 25 extends to an outside of two opposite ends of the insulating sleeve 24 so as to ensure that the insulating sleeve 24 is gaplessly connected to the transmission cable 22 and the pillar portion 232, but the present disclosure is not limited thereto. For example, in other embodiments of the present disclosure, the insulating sleeve 24 can be provided without the adhesive layer 25 thereon, and can directly surround the transmission cable 22 and the molding holder 23.

The water-proof colloid 3 is filled in the colloid space S so as to connect the metal housing 1 and the transmission cable assembly 2. The partition portion 231 is configured to isolate the fixing slot 13 from the accommodating slot 12, so that the accommodating slot 12 and the insertion opening 11 do not receive any part of the water-proof colloid 3. Moreover, the connection slot 16 and the extension slot 15 in the present embodiment do not receive any part of the water-proof colloid 3.

It should be noted that the colloid space S in the present embodiment is formed with a ring-shape by the structural design of the transmission cable assembly 2 (e.g., the structural designs of the partition portion 231, the pillar portion 232, and the insulating sleeve 24), so that the water-proof colloid 3 can be injected into the ring-shaped colloid space S all at once for increasing the manufacturing efficiency of the water-proof connection device 100, but the present disclosure is not limited thereto. For example, in other embodiments of the present disclosure, the colloid space S can be divided into two independent regions by the insulating sleeve 24 of the transmission cable assembly 2, and the water-proof colloid 3 can be injected into the two independent regions of the colloid space S through two injections.

Second Embodiment

Referring to FIG. 7 to FIG. 10, a second embodiment of the present disclosure is similar to the first embodiment of the present disclosure. For the sake of brevity, descriptions of the same components in the first and second embodiments of the present disclosure will be omitted herein, and the following description only discloses different features between the first and second embodiments.

In the present embodiment, the transmission cable assembly 2 further includes a shielding layer 26 (e.g., a copper layer) surrounding the pillar portion 232 and a grounding braid 27 that is arranged in the transmission cable 22 and that surrounds the wires 221. The shielding layer 26 is arranged outside of the connection parts of the internal end portion 212 and the wires 221. In other words, the connection parts of the internal end portion 212 and the wires 221 in the present embodiment are arranged in a space surroundingly defined by the shielding layer 26. Moreover, the grounding braid 27 is connected to the shielding layer 26 so as to be commonly grounded, thereby effectively preventing external signals from interfering with the signal transmission between the internal end portion 212 and the wires 221. In addition, the insulating sleeve 24 surrounds a part of the shielding layer 26 and a junction between the shielding layer 26 and the grounding braid 27, thereby protecting the junction between the shielding layer 26 and the grounding braid 27.

In conclusion, the transmission cable assembly in the present disclosure is provided with the pillar portion of the molding holder formed on and surrounding the connection parts of the internal end portion and the wires, so that the structural connection and signal transmission between the connector and the transmission cable can be firmly maintained, and the water-proof function and the structural strength of the transmission cable assembly can be effectively achieved.

Moreover, the colloid space in the present disclosure is formed with a ring-shape by the structural design of the transmission cable assembly (e.g., the structural designs of the partition portion, the pillar portion, and the insulating sleeve), so that the water-proof colloid can be injected into the ring-shaped colloid space at one time for increasing the manufacturing efficiency of the water-proof connection device.

In addition, the insulating sleeve in the present disclosure is adhered to the part of the pillar portion and the part of the transmission cable that are arranged adjacent to each other by the adhesive layer, and the adhesive layer extends to an outside of two opposite ends of the insulating sleeve so as to ensure that the insulating sleeve is gaplessly connected to the transmission cable and the pillar portion.

Furthermore, the shielding layer in the present disclosure is connected to the grounding braid and is arranged outside of the connection parts of the internal end portion and the wires, thereby effectively preventing external signals from interfering with the signal transmission between the internal end portion and the wires.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A water-proof connection device, comprising:

a metal housing having an insertion opening, an accommodating slot extending from the insertion opening along an insertion direction, and a fixing slot that extends from the accommodating slot along the insertion direction;

a transmission cable assembly inserted into the metal housing and including:

a connector in USB 3.0 type C and having an external end portion and an internal end portion that is opposite to the external end portion, wherein the external end portion is arranged in the accommodating slot and corresponds in position to the insertion opening;

a transmission cable including a plurality of wires connected to the internal end portion;

a molding holder including a partition portion and a pillar portion that extends from the partition portion, wherein a cross section of the partition portion perpendicular to the insertion direction has a shape that is identical to that of a cross section of the fixing slot perpendicular to the insertion direction, and connection parts of the internal end portion and the wires are embedded in the pillar portion; and an insulating sleeve surrounding a part of the pillar portion and a part of the transmission cable that are arranged adjacent to each other, wherein a surrounding lateral edge of the partition portion abuts against an inner wall of the fixing slot, and the fixing slot receives at least part of the pillar portion and a part of the insulating sleeve so as to leave a colloid space; and a water-proof colloid filled in the colloid space so as to connect the metal housing and the transmission cable assembly, wherein the partition portion is configured to isolate the fixing slot from the accommodating slot, so that the accommodating slot and the insertion opening do not receive any part of the water-proof colloid.

2. The water-proof connection device according to claim 1, wherein the metal housing includes a grounding component corresponding in position to the accommodating slot, and wherein the grounding component detachably abuts against the external end portion, so that the metal housing and the external end portion are commonly grounded.

3. The water-proof connection device according to claim 2, wherein the metal housing has a step surface connected to the inner wall of the fixing slot, and the metal housing has an extension slot and a connection slot that are recessed from the step surface in a direction away from the fixing slot, wherein the connection slot is in spatial communication with the accommodating slot, and the metal housing has a positioning portion separating the extension slot from the connection slot, and wherein the grounding component clamps the positioning portion, two opposite portions of the grounding component are respectively arranged in the extension slot and the connection slot, and one of the two opposite portions of the grounding component arranged in the connection slot detachably abuts against the external end portion.

4. The water-proof connection device according to claim 1, wherein the surrounding lateral edge of the partition portion and the inner wall of the fixing slot are interferingly fitted with each other so as to have an abutting region that is in a circular ring-shape.

5. The water-proof connection device according to claim 1, wherein an outer surface of the pillar portion is spaced apart from the surrounding lateral edge of the partition portion by a minimum distance, and a thickness of the insulating sleeve is smaller than the minimum distance, so that the colloid space is in a ring-shape, and the water-proof colloid is injected into the colloid space all at once.

6. The water-proof connection device according to claim 1, wherein the transmission cable assembly includes:

a shielding layer surrounding the pillar portion and arranged outside of the connection parts of the internal end portion and the wires; and a grounding braid arranged in the transmission cable and surrounding the wires, wherein the grounding braid is connected to the shielding layer, wherein the insulating sleeve surrounds a part of the shielding layer and a junction between the shielding layer and the grounding braid.

7. The water-proof connection device according to claim 1, wherein the transmission cable assembly includes an adhesive layer formed on an inner surface of the insulating sleeve, and wherein the adhesive layer extends to an outside of two opposite ends of the insulating sleeve.

8. The water-proof connection device according to claim 1, wherein when a high-pressure gas having 10 psi is injected into the water-proof connection device from the transmission cable, the high-pressure gas does not flow out of the water-proof connection device through the metal housing.

* * * * *